US010975724B2

(12) United States Patent
Sezer et al.

(10) Patent No.: US 10,975,724 B2
(45) Date of Patent: Apr. 13, 2021

(54) SYSTEM AND METHOD FOR SHROUD COOLING IN A GAS TURBINE ENGINE

(71) Applicant: General Electric Company, Schenectady, NY (US)

(72) Inventors: Ibrahim Sezer, Greenville, SC (US); Benjamin Paul Lacy, Greer, SC (US); Thomas James Brunt, Greenville, SC (US); Jason Ray Gregg, Greenville, SC (US)

(73) Assignee: General Electric Company, Schenectady, NY (US)

( * ) Notice: Subject to any disclaimer, the term of this patent is extended or adjusted under 35 U.S.C. 154(b) by 72 days.

(21) Appl. No.: 16/175,413

(22) Filed: Oct. 30, 2018

(65) Prior Publication Data

US 2020/0131932 A1 Apr. 30, 2020

(51) Int. Cl.
*F01D 25/14* (2006.01)

(52) U.S. Cl.
CPC ..... *F01D 25/14* (2013.01); *F05D 2240/11* (2013.01); *F05D 2260/201* (2013.01)

(58) Field of Classification Search
None
See application file for complete search history.

(56) References Cited

U.S. PATENT DOCUMENTS

| | | | | |
|---|---|---|---|---|
| 4,573,865 | A * | 3/1986 | Hsia | F01D 5/187 165/109.1 |
| 5,439,348 | A | 8/1995 | Hughes et al. | |
| 6,779,597 | B2 * | 8/2004 | DeMarche | F01D 11/24 165/169 |
| 7,665,962 | B1 * | 2/2010 | Liang | F01D 11/24 415/173.1 |
| 8,246,299 | B2 * | 8/2012 | Razzell | F01D 11/005 415/173.1 |
| 9,080,458 | B2 * | 7/2015 | Romanov | F01D 11/24 |
| 2014/0130504 | A1 * | 5/2014 | Chen | F01D 25/12 60/772 |

* cited by examiner

*Primary Examiner* — Juan G Flores
(74) *Attorney, Agent, or Firm* — Armstrong Teasdale LLP

(57) ABSTRACT

A rotary machine includes a rotatable member and a casing extending circumferentially over the rotatable member. The casing includes first and second target impingement surfaces. The cooling system includes first and second impingement plates. The first impingement plate is positioned over the first target impingement surface and at least a portion of the second target impingement surface. The first impingement plate defines a plurality of first impingement holes configured to channel a first flow of cooling fluid toward the first target impingement surface. The second impingement plate is positioned over the second target impingement surface. The second impingement plate defines a plurality of second impingement holes configured to channel a second flow of cooling fluid toward the second target impingement surface. A thickness of the casing in the first target impingement surface is different than a thickness of the casing in the second target impingement surface.

19 Claims, 5 Drawing Sheets

SYSTEM AND METHOD FOR SHROUD COOLING IN A GAS TURBINE ENGINE

BACKGROUND

The field of the disclosure relates generally to cooling systems for gas turbine engines, and more particularly to a cooling system for cooling localized regions on shrouds within gas turbine engines.

At least some known gas turbine engines include a shroud that circumscribes one or more of a high pressure compressor, a low pressure compressor, a combustion chamber, and a turbine. As the gas turbine engines become more powerful, temperatures generated within the gas turbine engine increase. The increased temperatures within the gas turbine engine may cause localized regions of the shroud to expand and contract more than the shroud would have expanded in a less powerful gas turbine engine. Specifically, those regions of the shroud adjacent to the rotating turbine blades may be exposed to higher temperatures that may cause the shroud to expand and increase a tip clearance defined between the shroud and the turbine blades. An increased tip clearance may increase tip leakage and decrease turbine efficiency.

Moreover, an amount of additional cooling flow needed to maintain tight clearances for the blade tips and the shroud clearance varies for different regions across the shroud. For example, at least some regions may require additional cooling depending on the thickness of the shroud at that location and the temperature of the shroud at that location. For at least some known gas turbine engines, supplying an increased amount of cooling fluid to the to the entire shroud decreases an operating efficiency of the gas turbine engine. As such, it would be desirable to devise a system of localized cooling of the shroud to facilitate increasing an efficiency of the gas turbine engine.

BRIEF DESCRIPTION

In one aspect, a cooling system for a rotary machine is provided. The rotary machine includes at least one rotatable member defining an axis of rotation and a casing extending circumferentially over at least a portion of the rotatable member. The casing includes a radially outer surface having a first target impingement surface and a second target impingement surface. The cooling system includes a first impingement plate and a second impingement plate. The first impingement plate is positioned over the first target impingement surface of the casing and at least a portion of the second target impingement surface of the casing. The first impingement plate defines a plurality of first impingement holes configured to channel a first flow of cooling fluid towards the first target impingement surface. The second impingement plate is positioned over the second target impingement surface of the casing. The second impingement plate defines a plurality of second impingement holes configured to channel a second flow of cooling fluid toward the second target impingement surface. A thickness of the casing in the first target impingement surface is different than a thickness of the casing in the second target impingement surface.

In another aspect, a method of cooling a casing is provided. The method includes channeling a first flow of cooling fluid from a cooling fluid source through a plurality of first impingement holes defined in a first impingement plate to a first region of the casing. The first region of the casing has a first thickness. The method also includes channeling a second flow of cooling fluid from the cooling fluid source through a plurality of second impingement holes defined in a second impingement plate to a second region of the casing. The second region of the casing has a second thickness. The first thickness is different than the second thickness.

In another aspect, a rotary machine is provided. The rotary machine includes a section, a casing, and a cooling system. The section defines an axis of rotation. The casing circumscribes the section and includes a radially outer surface having a first target impingement surface and a second target impingement surface. The cooling system is positioned on the casing and includes a first impingement plate and a second impingement plate. The first impingement plate is positioned over the first target impingement surface of the casing and at least a portion of the second target impingement surface of the casing. The first impingement plate defines a plurality of first impingement holes configured to channel a first flow of cooling fluid towards the first target impingement surface. The second impingement plate is positioned over the second target impingement surface of the casing. The second impingement plate defines a plurality of second impingement holes configured to channel a second flow of cooling fluid toward the second target impingement surface. A thickness of the casing in the first target impingement surface is different than a thickness of the casing in the second target impingement surface.

DETAILED DESCRIPTION

Figure 1:
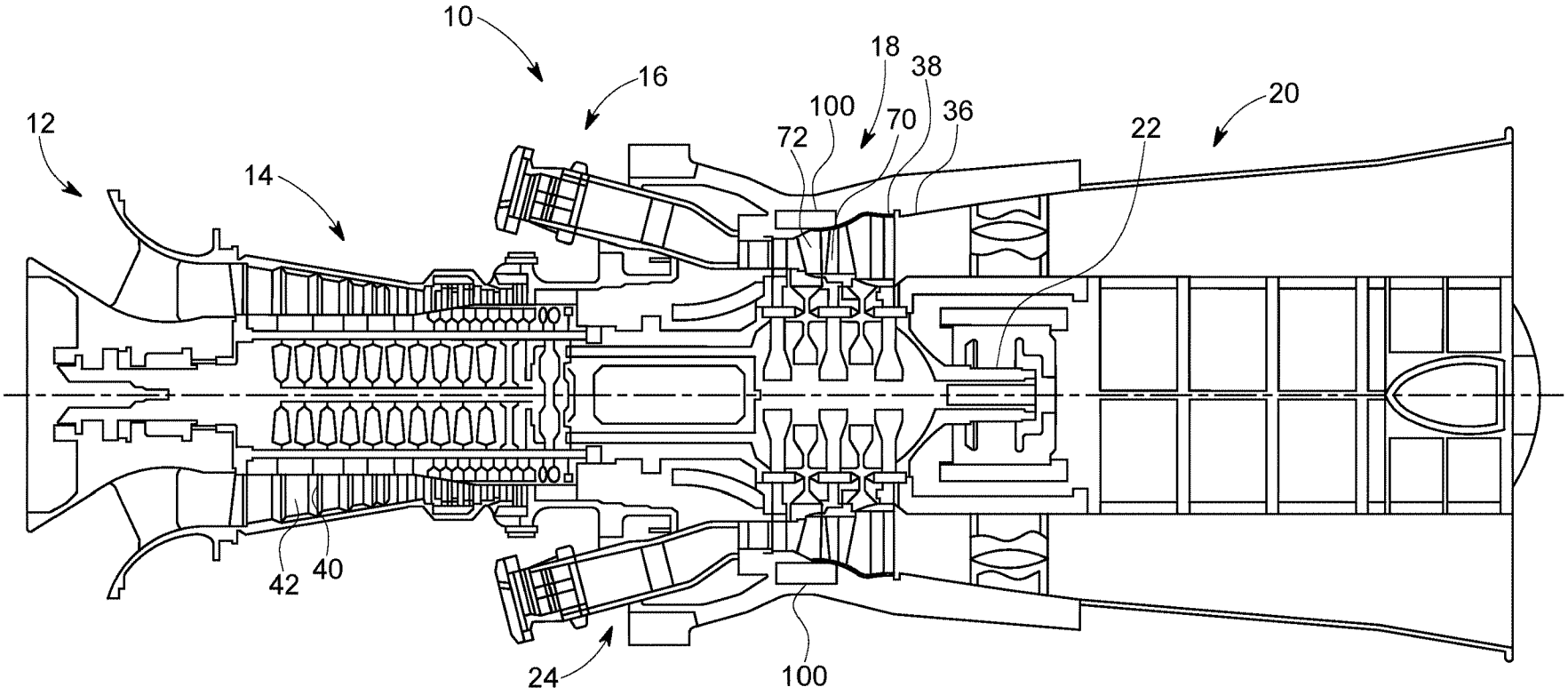
FIG. 1 is a schematic diagram of an exemplary rotary machine.

The exemplary casing cooling system and methods described herein facilitate increasing the efficiency of a rotary machine, decreasing the weight of the rotary machine, and cooling a casing of the rotary machine. The embodiments of the casing cooling systems described herein include a first impingement plate positioned over a first target impingement surface and a second impingement plate positioned over a second target impingement surface. The first and second impingement plates each include a plurality of impingement holes configured to channel a flow of impingement air to the first and second target impingement surfaces respectively. The first and second target impingement surfaces are located on an outer surface of a casing of the rotary machine. The second target impingement surface is positioned over a region of casing with an increased temperature, and, as such, has a higher operating temperature than the first target impingement surface. The thickness of the casing at the second target impingement surface is different than the thickness of the casing at the first target impingement surface. As such, the heat transfer effectiveness between the impingement air and the target impingement surface is higher at the second target impingement surface than the first target impingement surface for a given cooling flow.

In each embodiment, a first flow of impingement air is channeled to the first target impingement surface by the first impingement plate and after absorbing heat from the first target impingement surface, becomes a second flow of impingement air that is warmer than the first flow of impingement air. The second flow of impingement air is then channeled to the second target impingement surface via the second impingement plate and absorbs heat from the second target impingement surface. As such, in each embodiment, the first and second target impingement surfaces are cooled by a single flow of impingement air, increasing the efficiency of the rotary machine.

Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Approximating language may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be identified. Such ranges may be combined and/or interchanged, and include all the subranges contained therein unless context or language indicates otherwise.

Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item.

FIG. 1 is a schematic view of an exemplary rotary machine 10 with which embodiments of the current disclosure may be used. In the exemplary embodiment, rotary machine 10 is a gas turbine that includes an intake section 12, a compressor section 14 coupled downstream from intake section 12, a combustor section 16 coupled downstream from compressor section 14, a turbine section 18 coupled downstream from combustor section 16, and an exhaust section 20 coupled downstream from turbine section 18. A generally tubular casing 36 at least partially encloses one or more of intake section 12, compressor section 14, combustor section 16, turbine section 18, and exhaust section 20. A casing cooling system 100 is positioned on an outer surface 38 of casing 36 and is configured to cool a region of casing 36. In the exemplary embodiment, casing cooling system 100 is positioned on outer surface 38 proximate to turbine section 18. In alternative embodiments, casing cooling system 100 is positioned on outer surface 38 at any location that enables rotary machine 10 to operate as described herein. In alternative embodiments, rotary machine 10 is any machine having rotor blades for which the embodiments of the current disclosure are enabled to function as described herein.

In the exemplary embodiment, turbine section 18 is coupled to compressor section 14 via a rotor shaft 22. It should be noted that, as used herein, the term "couple" is not limited to a direct mechanical, electrical, and/or communication connection between components, but may also include an indirect mechanical, electrical, and/or communication connection between multiple components.

During operation of gas turbine 10, intake section 12 channels air towards compressor section 14. Compressor section 14 compresses the air to a higher pressure and temperature. More specifically, rotor shaft 22 imparts rotational energy to at least one circumferential row of compressor blades 40 coupled to rotor shaft 22 within compressor section 14. In the exemplary embodiment, each row of compressor blades 40 is preceded by a circumferential row of compressor stator vanes 42 extending radially inward from casing 36 that direct the air flow into compressor blades 40. The rotational energy of compressor blades 40 increases a pressure and temperature of the air. Compressor section 14 discharges the compressed air towards combustor section 16.

In combustor section 16, the compressed air is mixed with fuel and ignited to generate combustion gases that are channeled towards turbine section 18. More specifically, combustor section 16 includes at least one combustor 24, in which a fuel, for example, natural gas and/or fuel oil, is injected into the air flow, and the fuel-air mixture is ignited to generate high temperature combustion gases that are channeled towards turbine section 18.

Turbine section 18 converts thermal energy from the combustion gas stream to mechanical rotational energy. More specifically, the combustion gases impart rotational energy to at least one circumferential row of rotor blades 70 coupled to rotor shaft 22 within turbine section 18. In the exemplary embodiment, each row of rotor blades 70 is preceded by a circumferential row of turbine stator vanes 72 extending radially inward from casing 36 that direct the combustion gases into rotor blades 70. Rotor shaft 22 may be coupled to a load (not shown) such as, but not limited to, an electrical generator and/or a mechanical drive application. The exhausted combustion gases flow downstream from turbine section 18 into exhaust section 20. Components of rotary machine 10 in a hot gas path of rotary machine 10, such as, but not limited to, rotor blades 70, are subject to wear and/or damage from exposure to the high temperature gases.

Figure 2:
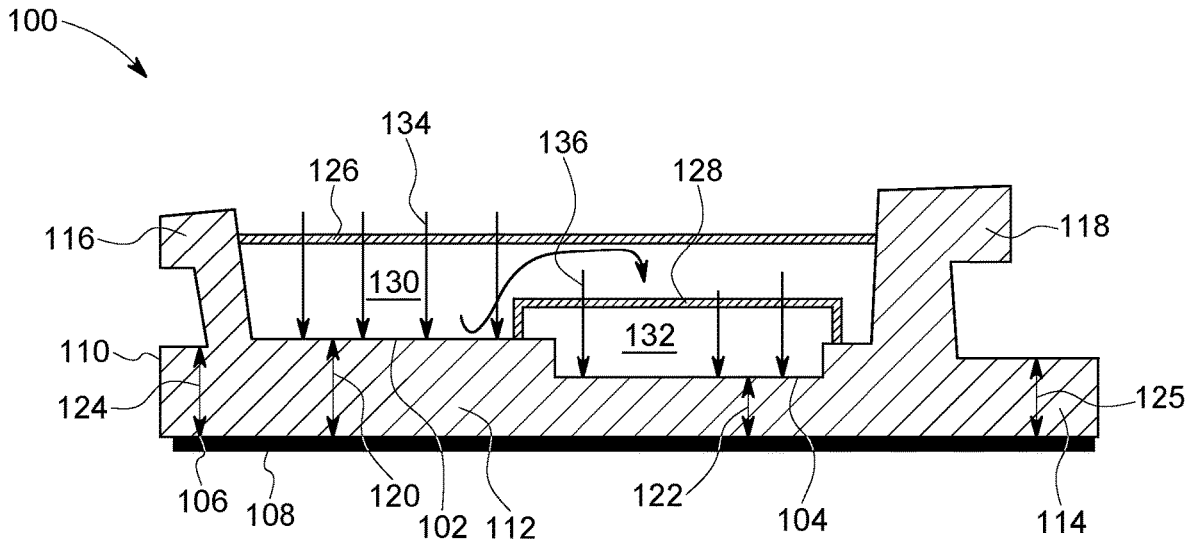
FIG. 2 is an enlarged schematic view of a cooling system positioned on an outer surface of a casing of the rotary machine shown in FIG. 1.

FIG. 2 is an enlarged schematic view of casing cooling system 100 positioned on casing outer surface 38 adjacent to turbine section 18 of rotary machine 10 (shown in FIG. 1). Specifically, in the exemplary embodiment, casing cooling system 100 is positioned proximate to a circumferential row of rotor blades 70. Alternatively, casing cooling system 100 may be positioned over any portion of rotary machine 10 that enables rotary machine 10 to operate as described herein. For example, casing cooling system 100 may be positioned over any portion of casing 36 that is exposed to high temperature and/or high velocity gases such as, without limitation, a stage 1 turbine nozzle. Casing outer surface 38 includes a first target impingement surface 102 and a second target impingement surface 104 that each at least partially circumscribe casing 36. Casing 36 also includes an inner surface 106 that circumscribes rotary machine 10. In the exemplary embodiment, inner surface 106 circumscribes rotor blades 70 of turbine section 18. In alternative embodiments, inner surface 106 may circumscribe any portion of rotary machine 10 that enables rotary machine 10 to operate as described herein. A coating 108 is applied to inner surface 106 to facilitate protecting casing 36 from high temperature, high velocity gases. Specifically, in the exemplary embodiment, coating 108 is a thermal barrier coating. Alternatively, coating 108 may be any type of coating that enables rotary machine 10 to operate as described herein.

In the exemplary embodiment, casing 36 includes first target impingement surface 102 and second target impingement surface 104. While two target impingement surfaces 102 and 104 are illustrated in FIG. 2, alternatively, casing 36 may include number of target impingement surfaces that enable rotary machine 10 to operate as described herein, including, without limitation, three, four, or five target impingement surfaces. Casing 36 typically includes a plurality of circumferential portions 110, 112, and 114 coupled to each other by a plurality of circumferential casing hook or shroud hooks 116 and 118. In the exemplary embodiment, a first circumferential portion 110 is coupled to a second circumferential portion 112 by a first casing hook 116, and second circumferential portion 112 is coupled to a third circumferential portion 114 by a second casing hook 118.

As shown in FIG. 2, second circumferential portion 114 includes first target impingement surface 102 and second target impingement surface 104. First target impingement surface 102 has a first target impingement surface thickness 120, and second target impingement surface 104 has a second target impingement surface thickness 122. Similarly, first circumferential portion 110 has a first circumferential portion thickness 124, and third circumferential portion 114 has a third circumferential portion thickness 125. As discussed below, thicknesses 120-125 are selected to provide mechanical support for rotary machine 10 while simultaneously enabling heat transfer through circumferential portions 110, 112, and 114.

Casing cooling system 100 includes a first impingement plate 126 and a second impingement plate 128. In the exemplary embodiment, first impingement plate 126 is coupled to first casing hook 116 and second casing hook 118 such that first impingement plate 126 is positioned over first target impingement surface 102 and second target impingement surface 104. In alternative embodiments, first impingement plate 126 may be positioned only over first target impingement surface 102, or first impingement plate 126 may be positioned over first target impingement surface 102 and only partially over second target impingement surface 104. In the exemplary embodiment, second impingement plate 128 is positioned only over second target impingement surface 104. In alternative embodiments, second impingement plate 128 may be positioned over second target impingement surface 104 and partially over first target impingement surface 102. Additionally, in the exemplary embodiment, second impingement plate 128 is coupled to second circumferential portion 112 such that first impingement plate 126 is positioned over second impingement plate 128. In alternative embodiments, first impingement plate 126 may not be positioned over second impingement plate 128, or first impingement plate 126 may be only partially positioned over second impingement plate 128.

In the exemplary embodiment, first impingement plate 126, second impingement plate 128, first casing hook 116, second casing hook 118, and first target impingement surface 102 define a first impingement zone 130. Second impingement plate 128 and second target impingement surface 104 define a second impingement zone 132. First impingement zone 130 extends circumferentially around casing 36 and channels a flow of cooling fluid around casing 36 to cool first target impingement surface 102. Similarly, second impingement zone 132 extends circumferentially around casing 36 and channels a flow of cooling fluid around casing 36 to cool second target impingement surface 104. In the exemplary embodiment, the flow of cooling fluid is a flow of impingement air. However, the flow of cooling fluid may be any type of cooling fluid that enables casing cooling system 100 to operate as described herein.

Figure 3:
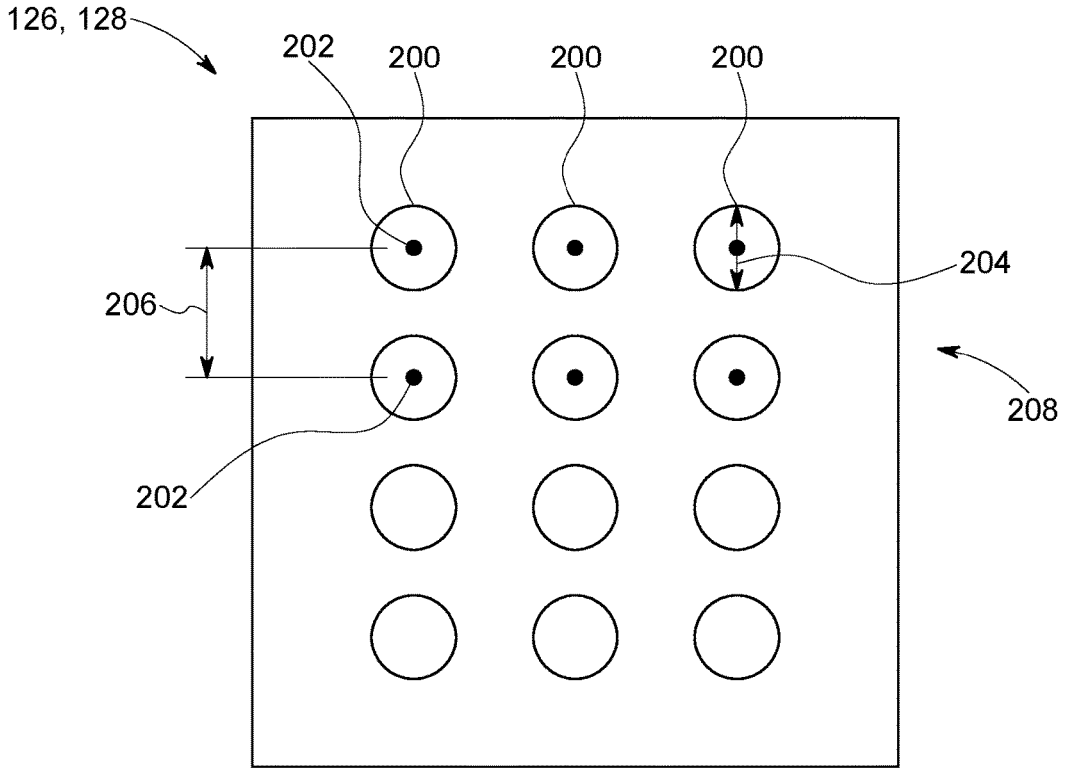
FIG. 3 is a schematic top view of a first impingement plate and a second impingement plate also with the casing cooling system shown in FIG. 2.

FIG. 3 is a schematic top view of first impingement plate 126 and second impingement plate 128. First impingement plate 126 and second impingement plate 128 each include a plurality of impingement holes 200 extending therethrough. Impingement holes 200 are organized and sized to channel a flow of impingement air into first impingement zone 130 and/or second impingement zone 132 to facilitate cooling first target impingement surface 102 and/or second target impingement surface 104. Each impingement hole 200 includes a centroid 202 and an impingement hole diameter 204. Impingement holes 200 depicted in FIG. 3 are organized with an impingement hole distance 206 defined between centroids 202 of adjacent impingement holes 200. Impingement holes 200 defined in first impingement plate 126 and second impingement plate 128 are organized in an impingement hole density pattern 208. In the exemplary embodiment, impingement hole distance 206 is a constant between all of impingement holes 200 such that impingement hole density pattern 208 is constant impingement hole density pattern 208. In alternative embodiments, impingement hole distance 206 may vary between adjacent impingement holes 200 such that impingement hole density pattern 208 is a varying impingement hole density pattern 208.

Impingement hole density pattern 208 defined within localized regions of first impingement plate 126 and second impingement plate 128 is one of the primary parameters which determine the flow rate, velocity, pressure drop, Reynolds Number, and, ultimately, the heat transfer coefficient of the flow of impingement air. That combination of parameters determines the ultimate heat transfer coefficient and heat transfer rate along first target impingement surface 102 and/or second target impingement surface 104.

Tuning the impingement hole density pattern 208 defined within localized regions of first target impingement surface 102 and/or second target impingement surface 104, along with compartmentalizing the cooling zones into first impingement zone 130 and second impingement zone 132, facilitates tuning the flow rate, velocity, pressure drop, Reynolds Number, and, ultimately, tuning the heat transfer coefficient along first target impingement surface 102 and/or second target impingement surface 104. Tuning the heat transfer coefficient to local requirements enables casing cooling system 100 to efficiently cool casing 36.

Referring to FIG. 2, during operations, a first flow of impingement air, indicated by arrow 134, is channeled into casing cooling system 100. In the exemplary embodiment, first flow of impingement air 134 is channeled from compressor section 14 (shown in FIG. 1) to casing cooling system 100. First flow of impingement air 134 may originate from any source of air that enables casing cooling system 100 to operate as described herein. First flow of impingement air 134 is at a first temperature. Impingement holes 200 within first impingement plate 126 channel first flow of impingement air 134 into first impingement zone 130 towards first target impingement surface 102. First flow of impingement air 134 absorbs heat from first target impingement surface 102 such that the operating temperature of first flow of impingement air 134 increases from the first temperature to a second temperature, while a temperature of first target impingement surface 102 decreases and first flow of impingement air 134 becomes a second flow of impingement air, indicated by arrow 136, with a higher operating temperature. Some or all of first flow of impingement air 134 becomes second flow of impingement air 136. For example, some of first flow of impingement air 134 may exit first impingement zone 130 through a plurality of cooling exit holes (not shown) before entering second impingement zone 132. Additionally, some of first flow of impingement air 134 may exit first impingement zone 130 through impingement holes 200 within first impingement plate 126 before entering second impingement zone 132. As such, some of first flow of impingement air 134 may exit the plurality of cooling exit holes or impingement holes 200 within first impingement plate 126 while some of first flow of impingement air 134 enters second impingement zone 132 through impingement holes 200 within second impingement plate 128. Alternatively, all of first flow of impingement air 134 may become second flow of impingement air 136 and flow into second impingement zone 132. Second flow of impingement air 136 is then channeled into second impingement zone 132 towards second target impingement surface 104 by impingement holes 200 within second impingement plate 128. Second flow of impingement air 136 absorbs additional heat from second target impingement surface 104 such that the temperature of second flow of impingement air 136 increases from the second temperature to a third temperature, while a temperature of second target impingement surface 104 decreases. As such, in the exemplary embodiment, first target impingement surface 102 and second target impingement surface 104 are cooled by a single flow of impingement air originating from first flow of impingement air 134. Because second flow of impingement air 136 originates from first flow of impingement air 134, a flow rate of second flow of impingement air 136 is less than or equal to a flow rate of first flow of impingement air 134. Conversely, the flow rate of first flow of impingement air 134 is greater than or equal to the flow rate of second flow of impingement air 136.

As shown in FIG. 2, second target impingement surface 104 is positioned directly over circumferential row of rotor blades 70. The region of casing 36 directly over circumferential row of rotor blades 70 (second target impingement surface 104) is exposed to higher temperatures than regions of casing 36 not directly over circumferential row of rotor blades 70 (first target impingement surface 102). As such, the temperature of first target impingement surface 102 is generally less than the temperature of second target impingement surface 104. However, the temperature of first target impingement surface 102 may be greater than or equal to the temperature of second target impingement surface 104. A temperature difference between a flow of impingement air 134 and 136 and a target impingement surface 102 and 104, among other factors, partially determines the overall heat transfer rate between flow of impingement air 134 and 136 and a target impingement surface 102 and 104. In the exemplary embodiment, flow of impingement air 134 is cooler than flow of impingement air 136 because flow of impingement air 136 has absorbed heat from first impingement surface 102. A sufficient temperature difference between second flow of impingement air 136 and second target impingement surface 104 drives heat transfer from second target impingement surface 104 to second flow of impingement air 136. Additionally, reusing first flow of impingement air 134 as second flow of impingement air 136 facilitates increasing the efficiency of rotary machine 10 because a dedicated additional cooling stream is not required to cool second target impingement surface 104.

Additionally, a heat transfer effectiveness between second flow of impingement air 136 and second target impingement surface 104 partially determines the overall heat transfer rate between second flow of impingement air 136 and second target impingement surface 104. The heat transfer effectiveness is partially determined by second target impingement surface thickness 122. Specifically, first target impingement surface thickness 120 is different than second target impingement surface thickness 122. In the exemplary embodiment, second target impingement surface thickness 122 is reduced such that second flow of impingement air 136 is closer to the heat load (i.e., circumferential row of rotor blades 70) and such that first target impingement surface thickness 120 is thicker than second target impingement surface thickness 122. As such, reducing second target impingement surface thickness 122 facilitates increasing the heat transfer effectiveness between second flow of impingement air 136 and second target impingement surface 104 and facilitates increasing the overall heat transfer rate between second flow of impingement air 136 and second target impingement surface 104. Increasing the overall heat transfer rate between second flow of impingement air 136 and second target impingement surface 104 facilitates increasing the efficiency of rotary machine 10. Moreover, reducing second target impingement surface thickness 122 may also reduce the weight of rotary machine 10.

However, while reducing second target impingement surface thickness 122 facilitates increasing the thermal efficiency of rotary machine 10, reducing second target impingement surface thickness 122 may also facilitate increasing mechanical stresses of casing 36 proximate to second target impingement surface 104. As such, the thickness of casing 36 is only reduced in areas where the highest heat loads are located along casing 36 (i.e., to second target impingement surface 104 over circumferential row of rotor blades 70). Additionally, second impingement plate 128 is positioned directly over second target impingement surface 104 to provide mechanical support to casing 36 around second target impingement surface 104. As such, second impingement plate 128 also provides a mechanical advantage to reduce the mechanical stresses caused by reducing second target impingement surface thickness 122. Moreover, first circumferential portion thickness 124 and third circumferential portion thickness 125 may be increased to provide a mechanical advantage to reduce the mechanical stresses caused by reducing second target impingement surface thickness 122.

Additionally, as described above, the flow rate, velocity, pressure drop, Reynolds Number, and, ultimately, the heat transfer coefficient of the second flow of impingement air 136 may be tuned by varying impingement hole distance 206, impingement hole diameter 204, and the impingement hole density pattern 208 of impingement holes 200 within first impingement plate 126 and second impingement plate 128. Additionally, the flow rate, velocity, pressure drop, Reynolds Number, and, ultimately, the heat transfer coefficient of the second flow of impingement air 136 may be tuned by varying a distance between first impingement plate 126 and first target impingement surface 102. As such, the heat transfer coefficient between second flow of impingement air 136 and second target impingement surface 104 can be increased or decreased in localized areas of second target impingement surface 104 to facilitates increasing the efficiency of rotary machine 10.

The exemplary embodiment illustrated in FIG. 2 included only two impingement zones, first impingement zone 130 and second impingement zone 132. However, casing cooling system 100 may include any number of impingement zones, including, without limitation, three, four, or more impingement zones, that enables casing cooling system 100 to operate as described herein. Furthermore, while casing cooling system 100 includes only two target impingement surfaces, first target impingement surface 102 and second target impingement surface 104, casing cooling system 100 may include any number of target surfaces, including, without limitation, three, four, or more target surfaces, that enables casing cooling system 100 to operate as described herein. That is, casing cooling system 100 may include more than two impingement zones that reuse impingement air more than once to cool more than two target surfaces.

Accordingly, the exemplary embodiment illustrated in FIGS. 2 and 3 facilitates increasing the efficiency of rotary machine 10 by cooling second target impingement surface 104 directly over circumferential row of rotor blades 70 and reusing first flow of impingement air 134 to cool second target impingement surface 104.

Figure 4:
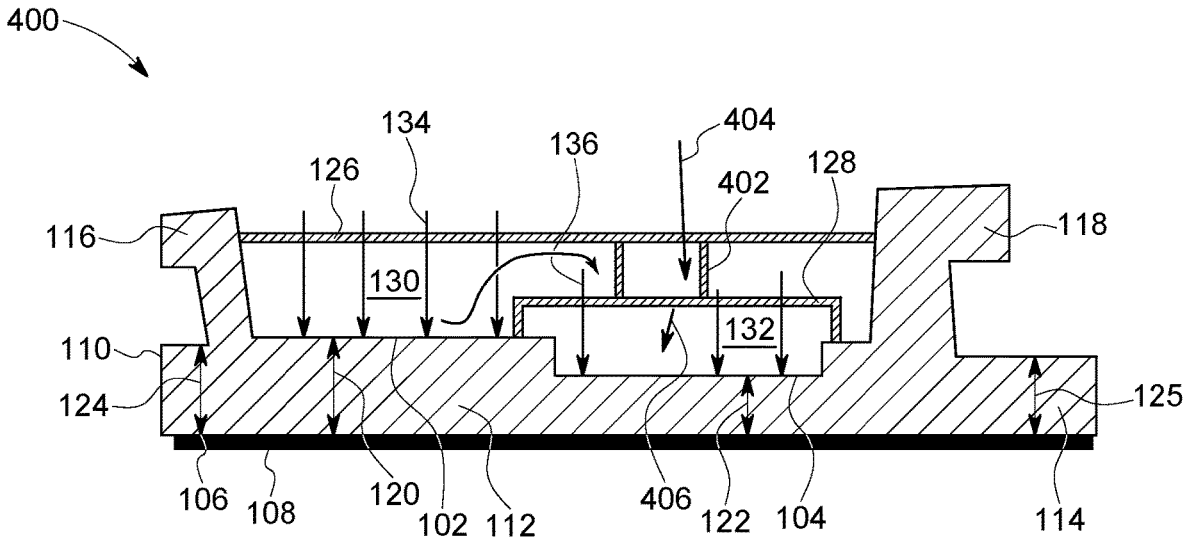
FIG. 4 is an enlarged schematic view of another cooling system positioned on an outer surface of a casing of the rotary machine shown in FIG. 1.

FIG. 4 is an enlarged schematic view of a casing cooling system 400 positioned on outer surface 38 of casing 36 proximate to turbine section 18 of rotary machine 10 (shown in FIG. 1). Casing cooling system 400 is substantially similar to casing cooling system 100 except that casing cooling system 400 includes a second impingement zone duct 402 configured to channel a third flow of impingement air, indicated by arrow 404, into second impingement zone 132. During operations, third flow of impingement air 404 is channeled from compressor section 14 (shown in FIG. 1) to casing cooling system 400. Third flow of impingement air 404 mixes with second flow of impingement air 136 within second impingement zone 132 and combines into a fourth flow of impingement air, indicated by arrow 406, directed to second target impingement surface 104. That is, third flow of impingement air 404 mixes with second flow of impingement air 136 to become fourth flow of impingement air 406 once both third flow of impingement air 404 and second flow of impingement air 136 have entered second impingement zone 132. As such, the temperature of third flow of impingement air 404 is less than the temperature of second flow of impingement air 136, and third flow of impingement air 404 reduces the temperature of second flow of impingement air 136 such that the temperature of fourth flow of impingement air 406 is less than the temperature of second flow of impingement air 136. As such, the temperature difference between fourth flow of impingement air 406 and second target impingement surface 104 is increased, and the overall heat transfer between fourth flow of impingement air 406 and second target impingement surface 104 is also increased. As such, mixing second flow of impingement air 136 with third flow of impingement air 404 facilitates increasing the overall heat transfer from second target impingement surface 104.

Figure 5:
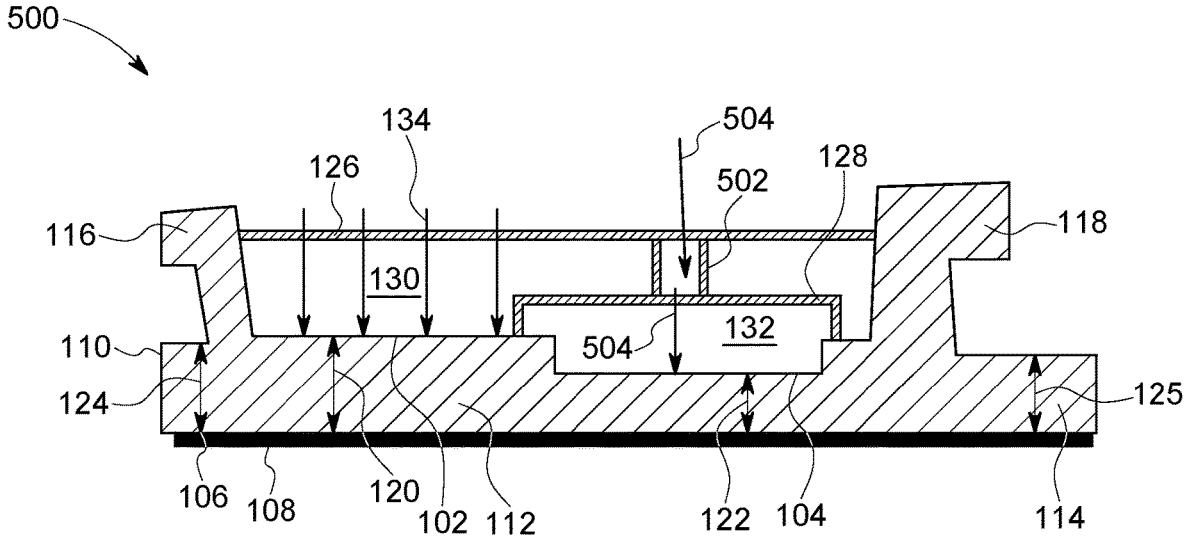
FIG. 5 is an enlarged schematic view of another cooling system positioned on an outer surface of a casing of the rotary machine shown in FIG. 1.

FIG. 5 is an enlarged schematic view of a casing cooling system 500 positioned on outer surface 38 of casing 36 proximate to turbine section 18 of rotary machine 10 (shown in FIG. 1). Casing cooling system 500 is substantially similar to casing cooling system 100 except that casing cooling system 500 includes a second impingement zone duct 502 configured to channel a fifth flow of impingement air, indicated by arrow 504, into second impingement zone 132. Additionally, second impingement plate 128 does not include any impingement holes 200 (shown in FIG. 3), and, as such, second flow of impingement air 136 is not channeled into second impingement zone 132. During operations, fifth flow of impingement air 504 is channeled from compressor section 14 (shown in FIG. 1) to casing cooling system 500 and is directed to second target impingement surface 104. As such, the temperature of fifth flow of impingement air 504 is less than the temperature of second flow of impingement air 136. As such, the temperature difference between fifth flow of impingement air 504 and second target impingement surface 104 is increased, and the overall heat transfer between fifth flow of impingement air 504 and second target impingement surface 104 is also increased. As such, directing a cooler fifth flow of impingement air 504 rather than a warmer second flow of impingement air 136 to second target impingement surface 104 facilitates increasing the overall heat transfer from second target impingement surface 104.

Figure 6:
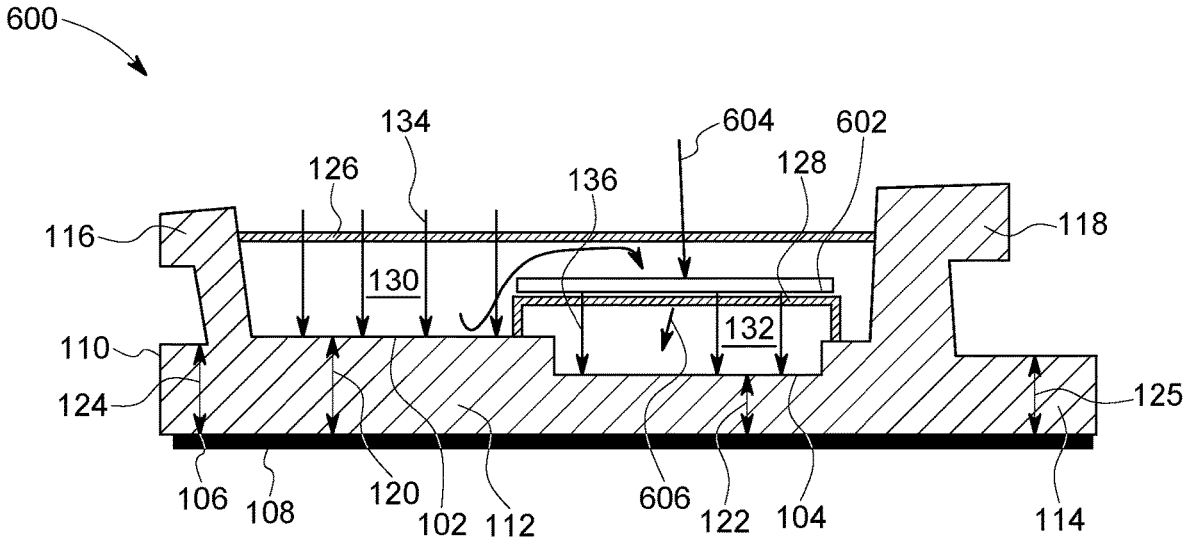
FIG. 6 is an enlarged schematic view of another cooling system positioned on an outer surface of a casing of the rotary machine shown in FIG. 1.

FIG. 6 is an enlarged schematic view of a casing cooling system 600 positioned on outer surface 38 of casing 36 proximate to turbine section 18 of rotary machine 10 (shown in FIG. 1). Casing cooling system 600 is substantially similar to casing cooling system 100 except that casing cooling system 400 includes a second impingement plate heat exchanger 602 configured to cool second flow of impingement air 136. In the exemplary embodiment, second impingement plate heat exchanger 602 is a plate a frame heat exchanger including a plurality of channels 604 configured to cool second flow of impingement air 136. Second impingement plate heat exchanger 602 may be additively manufactured to include channels 604 or may be manufactured by any method that enables second impingement plate heat exchanger 602 to operate as described herein. During operations, second flow of impingement air 136 is channeled through channels 604 of second impingement plate heat exchanger 602 such that the temperature of second flow of impingement air 136 is decreased to become a sixth flow of impingement air, indicated by arrow 606. As such, the temperature of sixth flow of impingement air 606 is less than the temperature of second flow of impingement air 136. The temperature difference between sixth flow of impingement air 606 and second target impingement surface 104 is increased, and the overall heat transfer between sixth flow of impingement air 606 and second target impingement surface 104 is also increased. As such, directing a cooler sixth flow of impingement air 606 rather than a warmer second flow of impingement air 136 to second target impingement surface 104 facilitates increasing the overall heat transfer from second target impingement surface 104.

Figure 7:
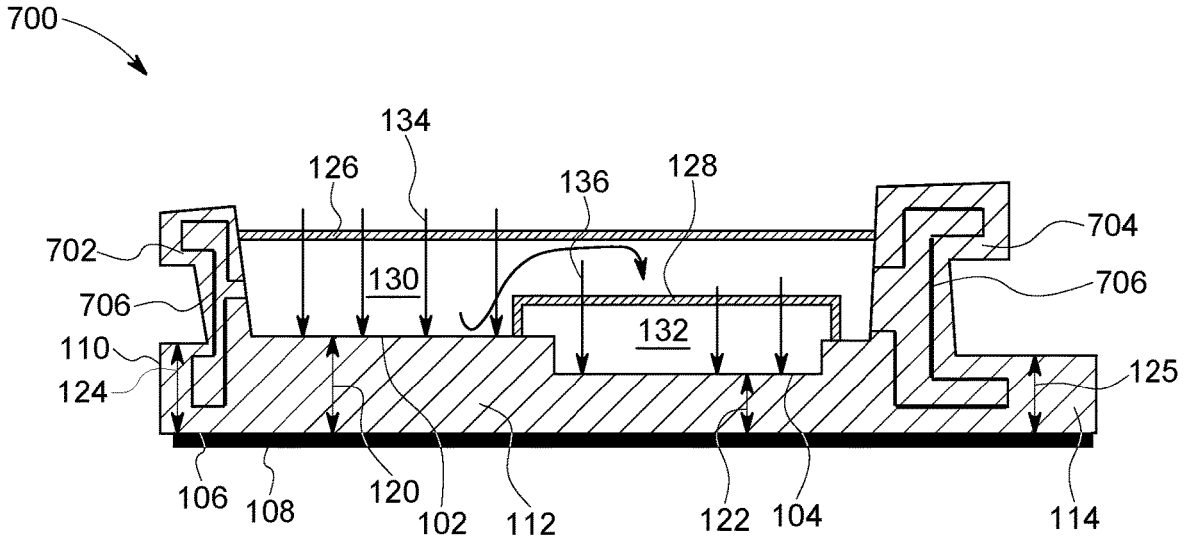
FIG. 7 is an enlarged schematic view of another cooling system positioned on an outer surface of a casing of the rotary machine shown in FIG. 1.

FIG. 7 is an enlarged schematic view of a casing cooling system 700 positioned on outer surface 38 of casing 36 proximate to turbine section 18 of rotary machine 10 (shown in FIG. 1). Casing cooling system 700 is substantially similar to casing cooling system 100 except that casing cooling system 700 includes a first casing hook 702 and a second casing hook 704 that each include a plurality of channels 706 configured to cool first flow of impingement air 134 and/or second flow of impingement air 136. That is, first casing hook 702 and second casing hook 704 are heat exchangers configured to cool first flow of impingement air 134 and/or second flow of impingement air 136. In the exemplary embodiment, first casing hook 702 and second casing hook 704 are additively manufactured to include channels 706 or may be manufactured by any method that enables first casing hook 702 and second casing hook 704 to operate as described herein. During operations, first flow of impingement air 134 and/or second flow of impingement air 136 are channeled through channels 706 of first casing hook 702 and second casing hook 704 such that the temperature of first flow of impingement air 134 and/or second flow of impingement air 136 are decreased. The cooler first flow of impingement air 134 and/or second flow of impingement air 136 are channeled back to first impingement zone 130 and/or second impingement zone 132 to reduce the temperature of first flow of impingement air 134 and/or second flow of impingement air 136. As such, the temperature difference between first flow of impingement air 134 and first target impingement surface 102 and/or second flow of impingement air 136 and second target impingement surface 104 is increased, and the overall heat transfer between first flow of impingement air 134 and first target impingement surface 102 and/or second flow of impingement air 136 and second target impingement surface 104 is also increased. As such, reducing the temperature of first flow of impingement air 134 and/or second flow of impingement air 136 facilitates increasing the overall heat transfer from second target impingement surface 104.

Figure 8:
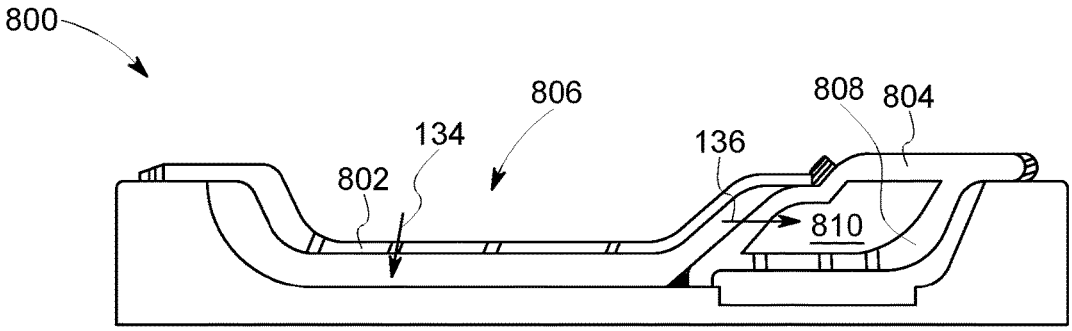
FIG. 8 is an enlarged schematic view of another cooling system positioned on an outer surface of a casing of the rotary machine shown in FIG. 1.

FIG. 8 is an enlarged schematic view of a casing cooling system 800 positioned on outer surface 38 of casing 36 proximate to turbine section 18 of rotary machine 10 (shown in FIG. 1). Casing cooling system 800 is substantially similar to casing cooling system 100 except that casing cooling system 800 includes a first impingement plate 802 and a second impingement plate 804 with different structural features than first impingement plate 126 and second impingement plate 128. For example, first impingement plate 802 defines a depression 806, and, as such, is closer to first target impingement surface 102. Depression 806 reduces a distance between first impingement plate 802 and first target impingement surface 102, and, as such, may improve the heat transfer effectiveness between first impingement plate 802 and first target impingement surface 102. Second impingement plate 804 includes an additional intermediate impingement zone wall 808 such that second impingement plate 804 defines an intermediate impingement zone 810. Intermediate impingement zone 810 controls the pressure drop of impingement air from first impingement zone 130 to second impingement zone 132. Intermediate impingement zone wall 808 includes a plurality of impingement holes 200 (shown in FIG. 3) configured to direct impingement air to second target impingement surface 104. During operations, first flow of impingement air 134 is channeled to first target impingement surface 102 and absorbs heat from first target impingement surface 102 to become second flow of impingement air 136. Second flow of impingement air 136 is then channeled into intermediate impingement zone 810 within second impingement plate 804. Second flow of impingement air 136 is then channeled into second impingement zone 132 to second target impingement surface 104 by impingement holes 200 within intermediate impingement zone wall 808. Second flow of impingement air 136 absorbs additional heat from second target impingement surface 104 such that the temperature of second target impingement surface 104 decreases. As such, in the exemplary embodiment, first target impingement surface 102 and second target impingement surface 104 are cooled by a single flow of impingement air.

Figure 9:
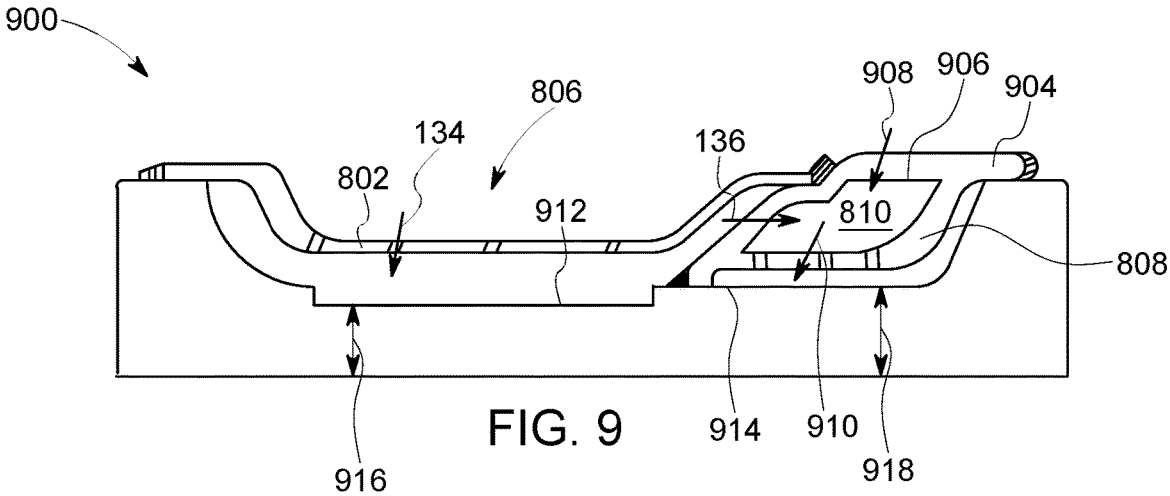
FIG. 9 is an enlarged schematic view of another cooling system positioned on an outer surface of a casing of the rotary machine shown in FIG. 1.

FIG. 9 is an enlarged schematic view of a casing cooling system 900 positioned on outer surface 38 of casing 36 proximate to turbine section 18 of rotary machine 10 (shown in FIG. 1). Casing cooling system 900 is substantially similar to casing cooling system 800 except that casing cooling system 900 includes a second impingement plate 904 with a second impingement zone duct 906 configured to channel a seventh flow of impingement air, indicated by arrow 908, into intermediate impingement zone 810. During operations, seventh flow of impingement air 908 is channeled from compressor section 14 (shown in FIG. 1) to casing cooling system 900. Seventh flow of impingement air 908 mixes with second flow of impingement air 136 and combines into an eighth flow of impingement air, indicated by arrow 910, within intermediate impingement zone 810. Eighth flow of impingement air 910 is then channeled into second impingement zone 132 to second target impingement surface 104 by impingement holes 200 within intermediate impingement zone wall 808. Eighth flow of impingement air 910 absorbs additional heat from second target impingement surface 104 such that the temperature of second target impingement surface 104 decreases. As such, the temperature of seventh flow of impingement air 908 is less than the temperature of second flow of impingement air 136, and seventh flow of impingement air 908 reduces the temperature of second flow of impingement air 136 such that the temperature of eighth flow of impingement air 910 is less than the temperature of second flow of impingement air 136. As such, the temperature difference between eighth flow of impingement air 910 and second target impingement surface 104 is increased, and the overall heat transfer between eighth flow of impingement air 910 and second target impingement surface 104 is also increased. As such, mixing second flow of impingement air 136 with seventh flow of impingement air 908 facilitates increasing the overall heat transfer from second target impingement surface 104.

As shown in FIG. 9, second circumferential portion 114 includes a third target impingement surface 912 and a fourth target impingement surface 914. Third target impingement surface 912 has a third target impingement surface thickness 916, and fourth target impingement surface 914 has a fourth target impingement surface thickness 918. As shown in FIGS. 2 and 4-8, first target impingement surface thickness 120 is different than second target impingement surface thickness 122. Specifically, first target impingement surface thickness 120 is greater than second target impingement surface thickness 122. However, target impingement surface thickness 120, 122, 916, and 918 may be varied such that the overall heat transfer rates and the heat transfer effectiveness of target impingement surfaces 102, 104, 912, and 914 is tuned to the requirements of rotary machine 10. For example, as shown in FIG. 9, third target impingement surface thickness 916 is less than fourth target impingement surface thickness 918. In the exemplary embodiment, third target impingement surface thickness 916 is reduced such that first flow of impingement air 134 is closer to a heat load below third target impingement surface 912. As such, reducing third target impingement surface thickness 916 facilitates increasing the heat transfer effectiveness between first flow of impingement air 134 and third target impingement surface 912 and facilitates increasing the overall heat transfer rate between first flow of impingement air 134 and third target impingement surface 912. Increasing the overall heat transfer rate between first flow of impingement air 134 and third target impingement surface 912 facilitates increasing the efficiency of rotary machine 10. Moreover, reducing third target impingement surface thickness 916 may also reduce the weight of rotary machine 10. Additionally, a heat transfer effectiveness between first flow of impingement air 134 and third target impingement surface 912 partially determines the overall heat transfer rate between first flow of impingement air 134 and third target impingement surface 912. The heat transfer effectiveness is partially determined by third target impingement surface thickness 916.

Figure 10:
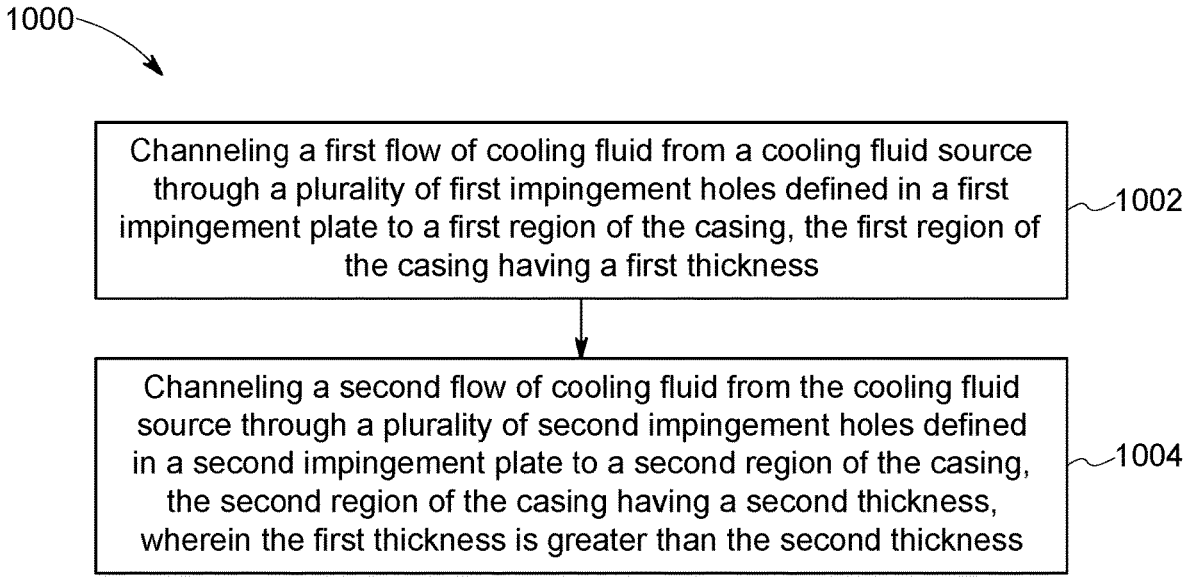
FIG. 10 is a flow diagram of an exemplary embodiment of a method of cooling a casing of the rotary machine shown in FIG. 1.

FIG. 10 is a flow diagram of an exemplary embodiment of a method 1000 of cooling casing 36. Method 1000 includes channeling 1002 a first flow of cooling fluid from a cooling fluid source (compressor section 14) through a plurality of first impingement holes 200 defined in a first impingement plate 126 to a first region 102 of the casing 36. The first region 102 of the casing has a first thickness 120. The method also includes channeling 1004 a second flow of cooling fluid from the cooling fluid source (compressor section 14) through a plurality of second impingement holes 200 defined in a second impingement plate 128 to a second region 104 of the casing 36. The second region 104 of the casing 36 has a second thickness 122. The first thickness 120 is greater than the second thickness 122.

Exemplary embodiments of a casing cooling system and methods described herein facilitate increasing the efficiency of a rotary machine, decreasing the weight of the rotary machine, and cooling a casing of the rotary machine. The embodiments of the casing cooling system described herein include a first impingement plate positioned over a first target impingement surface and a second impingement plate positioned over a second target impingement surface. The first and second impingement plates each include a plurality of impingement holes configured to channel a flow of impingement air to the first and second target impingement surfaces respectively. The first and second target impingement surfaces are located on an outer surface of a casing of the rotary machine. The second target impingement surface is positioned over a region of casing with an increased temperature, and, as such, has a higher temperature than the first target impingement surface. The thickness of the casing at the second target impingement surface is thinner than the thickness of the casing at the first target impingement surface. As such, the heat transfer coefficient between the impingement air and the target impingement surface is higher at the second target impingement surface than the first target impingement surface. A first flow of impingement air channeled to the first target impingement surface by the first impingement plate absorbs heat from the first target impingement surface and becomes a second flow of impingement air that is warmer than the first flow of impingement air. The second flow of impingement air is then channeled to the second target impingement surface by the second impingement plate and absorbs heat from the second target impingement surface. As such, first and second target impingement surfaces are cooled by a single flow of impingement air, this facilitates increasing the efficiency of the rotary machine.

The methods, apparatus, and systems described herein are not limited to the specific embodiments described herein. For example, components of each apparatus or system and/or steps of each method may be used and/or practiced independently and separately from other components and/or steps described herein. In addition, each component and/or step may also be used and/or practiced with other assemblies and methods.

While the disclosure has been described in terms of various specific embodiments, those skilled in the art will recognize that the disclosure can be practiced with modification within the spirit and scope of the claims. Although specific features of various embodiments of the disclosure may be shown in some drawings and not in others, this is for convenience only. Moreover, references to "one embodiment" in the above description are not intended to be interpreted as excluding the existence of additional embodiments that also incorporate the recited features. In accordance with the principles of the disclosure, any feature of a drawing may be referenced and/or claimed in combination with any feature of any other drawing.

What is claimed is:

1. A cooling system for a rotary machine, the rotary machine including at least one rotatable member defining an axis of rotation and a casing extending circumferentially over at least a portion of the rotatable member, the casing including a radially outer surface having a first target impingement surface and a second target impingement surface, said cooling system comprising:

a first impingement plate positioned over the first target impingement surface of the casing and at least a portion of the second target impingement surface of the casing, said first impingement plate defining a plurality of first impingement holes configured to channel a first flow of cooling fluid towards the first target impingement surface; and a second impingement plate extending from the first target impingement surface and positioned over the second target impingement surface of the casing, said second impingement plate defining a plurality of second impingement holes configured to channel a second flow of cooling fluid toward the second target impingement surface, wherein a thickness of the casing in the first target impingement surface is different than a thickness of the casing in the second target impingement surface.

2. The cooling system of claim 1, wherein the thickness of the casing in the first target impingement surface is thicker than the thickness of the casing in the second target impingement surface, wherein the at least one rotatable member includes a turbine rotor blade, and wherein the second target impingement surface is positioned in radial alignment with the turbine rotor blade.

3. The cooling system of claim 1, wherein said first impingement plate, said second impingement plate, and the first target impingement surface define a first impingement zone, said first impingement plate is configured to channel the first flow of cooling fluid into the first impingement zone.

4. The cooling system of claim 3, wherein said second impingement plate and the second target impingement surface define a second impingement zone, said second impingement plate is configured to channel the second flow of cooling fluid into the second impingement zone.

5. The cooling system of claim 4, wherein the first flow of cooling fluid absorbs heat from the first target impingement surface and is recycled as the second flow of cooling fluid.

6. The cooling system of claim 1, wherein said second impingement plate includes a second impingement plate duct configured to channel a third flow of cooling fluid toward the second target impingement surface, wherein the third flow of cooling fluid mixes with the second flow of cooling fluid.

7. The cooling system of claim 1, wherein said second impingement plate includes a second impingement plate heat exchanger configured to cool the second flow of cooling fluid.

8. The cooling system of claim 7, wherein said second impingement plate heat exchanger is a plate and frame heat exchanger positioned on said second impingement plate.

9. A method of cooling a casing, said method comprising:

channeling a first flow of cooling fluid from a cooling fluid source through a plurality of first impingement holes defined in a first impingement plate to a first region of the casing, the first region of the casing having a first thickness;

channeling a second flow of cooling fluid from the cooling fluid source through a plurality of second impingement holes defined in a second impingement plate to a second region of the casing, the second region of the casing having a second thickness, wherein the first thickness is different than the second thickness; and channeling a third flow of cooling fluid from the cooling fluid source through a second impingement plate duct of the second impingement plate to the second region of the casing, wherein the third flow of cooling fluid mixes with the second flow of cooling fluid.

10. The method of claim 9, wherein the first thickness is thicker than the second thickness.

11. The method of claim 9, wherein channeling the first flow of cooling fluid from the cooling fluid source through the plurality of first impingement holes defined in the first impingement plate to the first region of the casing comprises channeling the first flow of cooling fluid to a first impingement zone, wherein the first impingement plate, the first region of the casing, and the second impingement plate define the first impingement zone.

12. The method of claim 11, wherein channeling the second flow of cooling fluid from the cooling fluid source through the plurality of second impingement holes defined in the second impingement plate to the second region of the casing comprises channeling the second flow of cooling fluid from the first impingement zone through the plurality of second impingement holes defined in the second impingement plate to a second impingement zone, wherein the second impingement plate and the second region of the casing define the second impingement zone.

13. The method of claim 11, further comprising channeling an intermediate flow of cooling fluid from the first impingement zone into an intermediate impingement zone, wherein the second impingement plate defines the intermediate impingement zone.

14. A rotary machine comprising:

a section defining an axis of rotation;

a casing circumscribing said section, said casing including a radially outer surface having a first target impingement surface and a second target impingement surface, said casing has a casing thickness; and a cooling system positioned on said casing, said cooling system comprising:

a first impingement plate positioned over the first target impingement surface of the casing and at least a portion of the second target impingement surface of the casing, said first impingement plate defining a plurality of first impingement holes configured to channel a first flow of cooling fluid towards the first target impingement surface; and a second impingement plate positioned over the second target impingement surface of the casing, said second impingement plate defining a plurality of second impingement holes configured to channel a second flow of cooling fluid toward the second target impingement surface, wherein a thickness of the casing in the first target impingement surface is different than a thickness of the casing in the second target impingement surface, and wherein said second impingement plate includes a second impingement plate duct configured to channel a third flow of cooling fluid toward the second target impingement surface, wherein the third flow of cooling fluid mixes with the second flow of cooling fluid.

15. The rotary machine of claim 14, wherein the thickness of the casing in the first target impingement surface is thicker than the thickness of the casing in the second target impingement surface.

16. The rotary machine of claim 14, wherein said first impingement plate, said second impingement plate, and the first target impingement surface define a first impingement zone, wherein said first impingement plate is configured to channel the first flow of cooling fluid into the first impingement zone.

17. The rotary machine of claim 16, wherein said second impingement plate and the second target impingement surface define a second impingement zone, wherein said second impingement plate is configured to channel the second flow of cooling fluid into the second impingement zone.

18. The rotary machine of claim 17, wherein the first flow of cooling fluid absorbs heat from the first target impingement surface and is recycled as the second flow of cooling fluid.

19. The rotary machine of claim 14, wherein said second impingement plate includes a second impingement plate heat exchanger configured to cool the second flow of cooling fluid.

* * * * *